US005720190A

United States Patent [19]

Johnson et al.

[11] Patent Number: 5,720,190

[45] Date of Patent: Feb. 24, 1998

[54] LOW TORQUE WASHING MACHINE TRANSMISSION

[75] Inventors: Roger Neal Johnson, Hagaman; Sudhir Dattatraya Savkar, Schenectady; Robert Elmer Sundell, Clifton Park, all of N.Y.

[73] Assignee: General Electric Company, Schenectady, N.Y.

[21] Appl. No.: 767,648

[22] Filed: Dec. 17, 1996

Related U.S. Application Data

[62] Division of Ser. No. 573,815, Dec. 18, 1995, Pat. No. 5,655,389.

[51] Int. Cl.[6] ..... D06F 17/08; D06F 37/40

[52] U.S. Cl. ..... 68/133; 68/23.7; 74/78

[58] Field of Search ..... 68/23.7, 133; 74/78

[56] References Cited

U.S. PATENT DOCUMENTS

| | | | |
|---|---|---|---|
| 1,787,724 | 1/1931 | Fedler | 74/78 |
| 1,890,602 | 12/1932 | Dunham | 74/78 |
| 2,720,790 | 10/1955 | Sacchini | 74/78 X |
| 3,845,642 | 11/1974 | Cochran | 68/23.7 |

*Primary Examiner*—Philip R. Coe

*Attorney, Agent, or Firm*—Douglas E. Erickson; Marvin Snyder

[57] ABSTRACT

A transmission for driving an agitator in a washing machine includes a housing, an input shaft for being driven by a motor, and an output shaft for driving the agitator. The input shaft includes a crank disposed in the housing, and the output shaft includes a pinion disposed in the housing adjacent to the crank. A yoke is slidably mounted in the housing between the crank and pinion, and includes a rack operatively engaging the pinion along a pitchline, and a slot having a slot axis disposed perpendicularly to the pitchline which receives therein a slider rotatably joined to the crank. Rotation of the crank sinusoidally reciprocates the rack as the slider reciprocates in the slot, and reciprocation of the rack sinusoidally oscillates the pinion for driving the output shaft with minimum peak torque and drive power.

1 Claim, 4 Drawing Sheets

LOW TORQUE WASHING MACHINE TRANSMISSION

This application is a division of application Ser. No. 08/573,815, filed Dec. 18, 1995, and now U.S. Pat. No. 5,655,389.

BACKGROUND OF THE INVENTION

The present invention relates generally to clothes washing machines, and, more specifically, to a transmission therein.

In a typical machine for washing clothes, a vertical agitator is oscillated in two rotary directions during a wash cycle for washing clothes, and is driven in a single rotary direction during a spin cycle for removing water from the clothes by centrifugal force. The washer includes a transmission having an input shaft driven by an electrical motor, and an output shaft to which the agitator is mounted. The transmission typically includes a four-bar linkage or mechanism which converts unidirectional rotary motion to bi-directional oscillatory motion during the wash cycle. The mechanism includes a crank joined to the input shaft, with the crank being in turn joined to a connecting rod which in turn is connected to a follower link which is joined to the output shaft. The input and output shafts are suitably mounted in bearings and spaced apart from each other so that rotation of the crank in circles effects oscillatory movement of the follower arm over a predetermined arc which determines the angular amplitude of agitator stroke in each cycle.

To obtain acceptable washing performance in the washer, the agitator must be oscillated at suitable stroke rate or angular velocity and with a suitable stroke arc or angular amplitude. The agitator must be driven with suitable torque and power to overcome the resistance due to the clothes and water in the washer which undergo agitation by the agitator during the wash cycle. Accordingly, the motor which drives the transmission must be correspondingly sized in output torque and power for meeting the demands of effectively washing the clothes.

Analysis of a typical four-bar transmission indicates that although the stroke amplitude effects an oscillatory cycle, the stroke motion diverges from a pure sine waveform. Since the stroke rate, or velocity, and acceleration are time derivatives of the stroke amplitude, they in turn diverge from corresponding sine waveforms. It can be shown that any divergence from a pure sine waveform increases the peak torque on the agitator shaft. The torque for oscillating the agitator is supplied by the motor through the transmission. Accordingly, the larger torques due to the non-sinusoidal stroke motion requires a suitably large drive motor for driving the agitator.

SUMMARY OF THE INVENTION

A transmission for driving an agitator in a washing machine includes a housing, an input shaft for being driven by a motor, and an output shaft for driving the agitator. The input shaft includes a crank disposed in the housing, and the output shaft includes a pinion disposed in the housing adjacent to the crank. A yoke is slidably mounted in the housing between the crank and pinion, and includes a rack operatively engaging the pinion along a pitchline, and a slot having a slot axis disposed perpendicularly to the pitchline which receives therein a slider rotatably joined to the crank. Rotation of the crank reciprocates the rack as the slider reciprocates in the slot, and reciprocation of the rack sinusoidally oscillates the pinion for driving the output shaft with minimum peak torque and drive power.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT (S)

Figure 1:
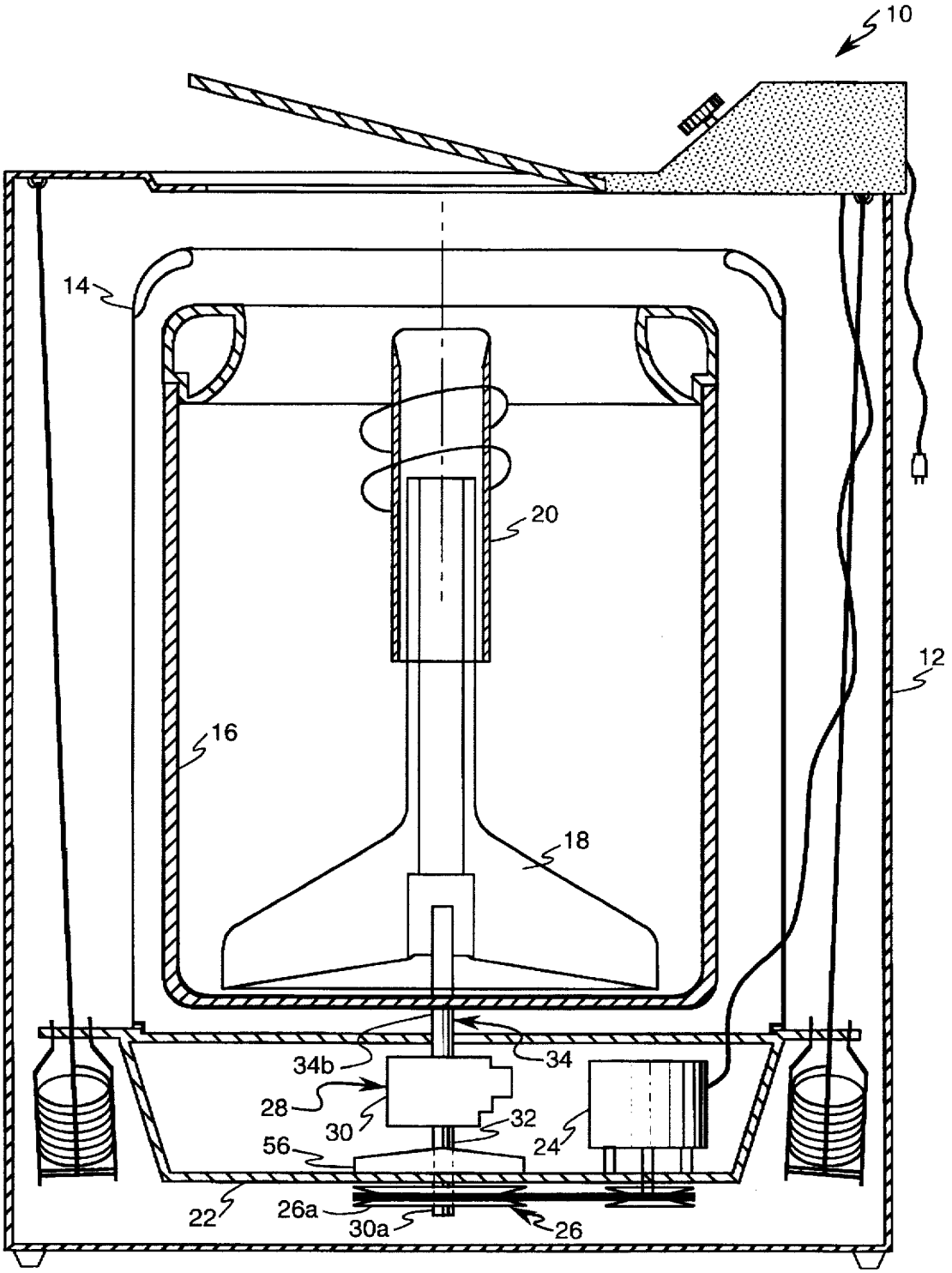
FIG. 1 is a schematic, elevational, partly sectional view of a machine for washing clothes having a vertical agitator driven by a transmission in accordance with one embodiment of the present invention.

Illustrated in FIG. 1 is a machine 10 for washing clothes (not shown), also referred to as a clothes washer. The washer 10 includes a cabinet 12 having a suitable control panel and lid at the top thereof. A tub 14 is suitably suspended inside the cabinet 12 and includes therein a basket 16 for receiving a washing fluid, such as soap and water, and the clothes to be washed. Disposed in the basket 16 is a suitable clothes agitator 18 which preferably includes a ratcheting auger disposed at the top thereof with both arranged about a vertical centerline axis.

Suitably suspended from the bottom of the tub 14 is a frame 22 which supports an electrical motor 24 which is operatively joined by a suitable belt drive 26 to a transmission 28 which is used to oscillate the agitator 18 in a wash cycle. In accordance with the present invention, the transmission 28 converts unidirectional rotary motion to bidirectional sinusoidal rotary motion to drive the agitator 18, with the sinusoidal motion requiring the lowest peak torque and drive power from the motor 24.

Figure 2:
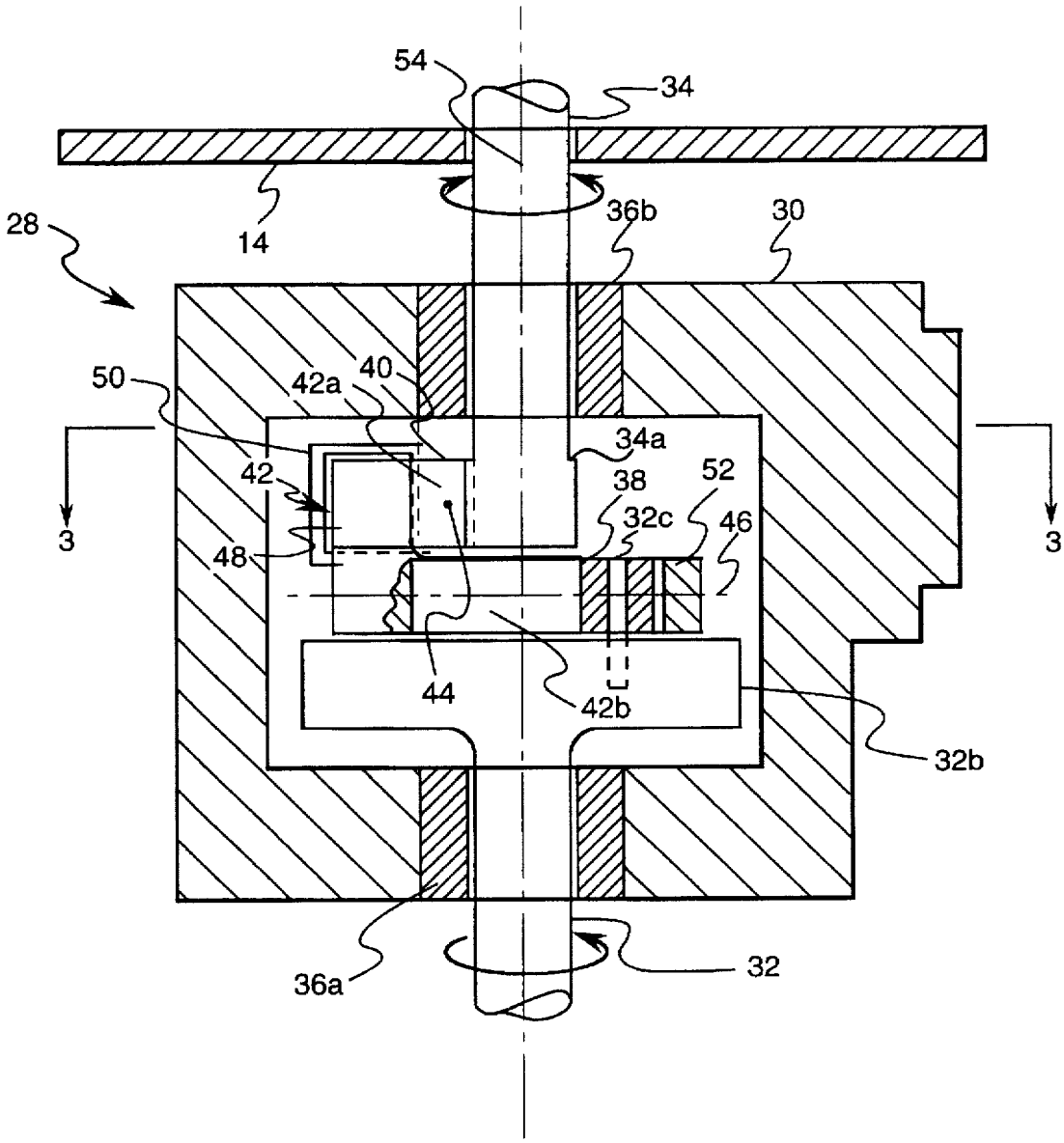
FIG. 2 is an elevational, partly sectional view through the transmission illustrated in FIG. 1 in accordance with an exemplary embodiment of the present invention.
Figure 3:
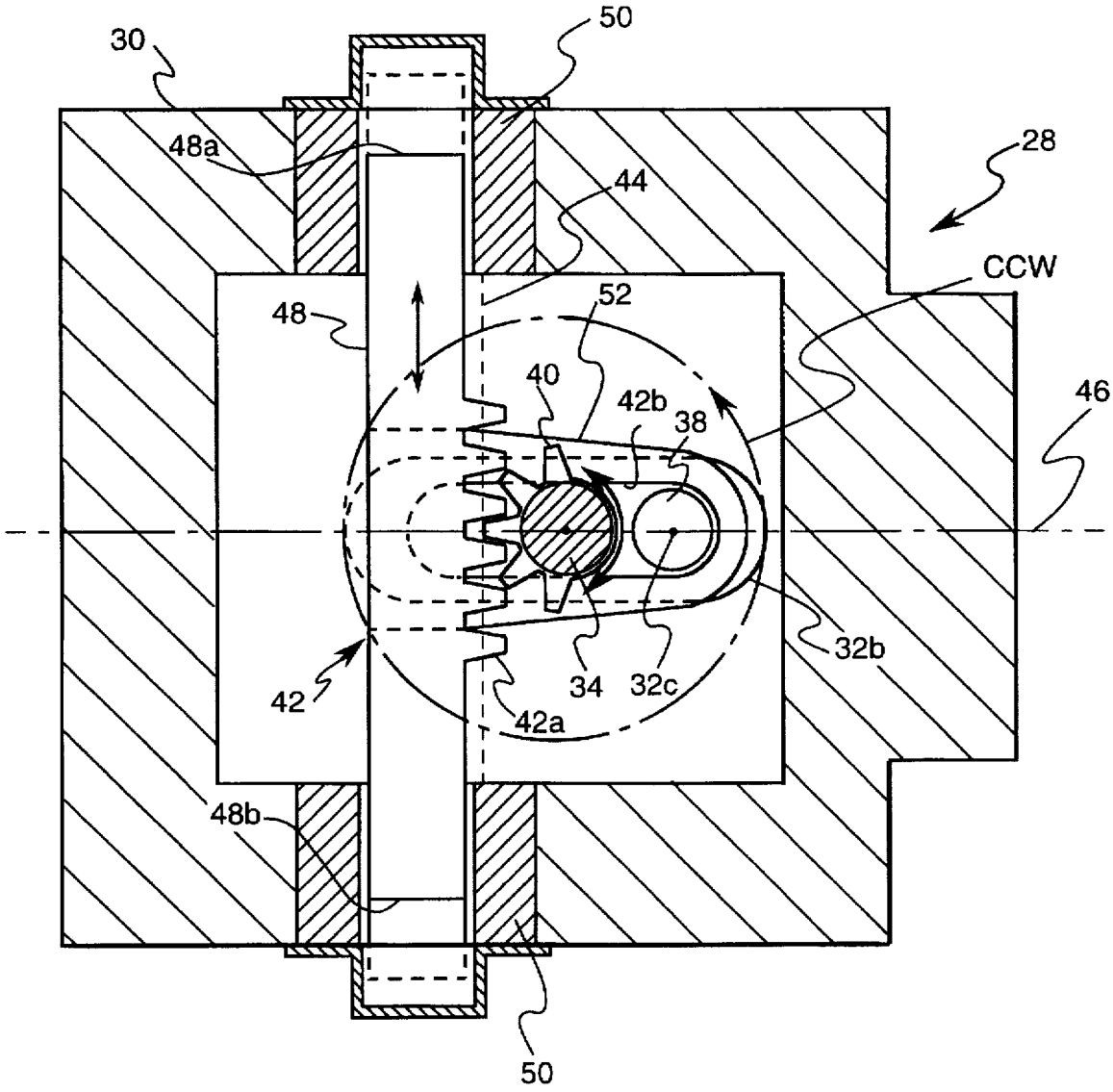
FIG. 3 is a horizontal, partly sectional view of the transmission illustrated in FIG. 2 and taken generally along line 3—3.

The transmission 28 is illustrated in FIGS. 2 and 3 in accordance with an exemplary embodiment of the present invention. As shown in FIG. 2, the transmission 28 includes a housing 30, an input shaft 32 extending into the housing 30 from below, and an output shaft 34 extending into the housing 30 from above. As shown in FIG. 1, the top or distal end **34*b* of the output shaft 34 extends upwardly through the base of the tub 14 and is suitably joined to the agitator 18. The lower drive end 32*a* of the input shaft 32 extends downwardly outside the housing 30 and through the base of the frame 22, and is suitably joined to the belt drive 26 for being rotated in a single or first direction by the motor 24**.

As shown in FIG. 2, the upper or opposite end of the input shaft 32 is disposed inside the housing 30 and includes an integral crank arm, or simply crank, **32*b*. A conventional sealed lower bearing 36*a*, such as a simple bushing, rotatably mounts the input shaft 32 in the housing 30. A similar sealed upper bearing 36*b* rotatably mounts the output shaft 34 in the housing 30. In this way, a suitable lubricant may be provided inside the housing 30** and is thereby sealed from leaking therefrom.

The crank **32*b* extends horizontally and includes a suitable crank pin 32*c*** which is fixedly joined thereto and extends vertically and parallel from the centerline axis of the input shaft 32. A suitable slider 38 in the exemplary form of a roller bearing is rotatably joined to the distal end of the crank 32*b* by being mounted on the crank pin 32*c*.

As shown in FIGS. 2 and 3, the output shaft 34 has an integral output gear or pinion 40 at its lower end 34*a* disposed inside the housing 30. The output shaft upper driven end 34*b*, shown in FIG. 1, is disposed outside the housing 30 and is suitably joined to the agitator 18 for driving it in the wash cycle.

Referring again to FIGS. 2 and 3, a yoke 42 is slidably mounted inside the housing 30 between the crank 32*b* and the pinion 40, and includes a rack 42*a* which operatively engages the pinion 40 along a straight pitchline 44, shown best in FIG. 3. The yoke 42 further includes an elongate slot 42*b* having a longitudinal slot axis 46 disposed perpendicularly to the rack pitchline 44 as shown in FIG. 3. The yoke slot 42*b* receives the slider 38 therein so that rotation of the input shaft 32 in the first direction, which is counterclockwise (CCW) as illustrated in FIG. 3, causes the rack 42*a* to linearly reciprocate as the slider 38 reciprocates in the slot 42*b* upon rotation of the crank 32*b*. Linear reciprocation of the rack 42*a* oscillates the pinion 40 in alternating opposite rotary directions for in turn oscillating the output shaft 34 to drive or oscillate the agitator 18.

The cooperating input and output shafts 32, 34 and yoke 42 are specially configured in accordance with one embodiment of the present invention to define a specific type of four-bar mechanism operating in a manner similar to a Scotch-yoke wherein rotary input motion causes pure sinusoidal output oscillation within available manufacturing tolerances. The rotary motion of the input shaft 32, and in turn the crank 32*b*, translates the yoke 42 in alternating and opposite linear directions so that the gear teeth of the rack 42*a* drive the cooperating gear teeth of the pinion 40 in opposite clockwise and counterclockwise directions for obtaining sinusoidal oscillating motion of the agitator 18. The time derivatives of the sinusoidal motion of the agitator 18 results in corresponding sinusoidal waveforms of the stroke angular velocity and acceleration. In accordance with the present invention, sinusoidal agitator motion requires the lowest peak torque and drive power of any waveform which therefore minimizes the peak torque and power requirements of the motor 24 for enhancing its life as well as the life of the entire drive train between the agitator 18 and the motor 24.

In the exemplary embodiment of the transmission 28 illustrated in FIGS. 2 and 3, the yoke 42 preferably includes an integral rod 48 having opposite ends 48*a* and 48*b*, as shown in FIG. 3, which are suitably slidably mounted in the housing 30, using suitable bushings 50 for example. The rod ends 48*a*,*b* and corresponding bushings 50 may have corresponding square transverse sections for maintaining proper alignment between the input and output shafts 32, 34 and for reacting loads generated during operation. As shown in FIG. 3, the rod 48 is mounted to the housing 30 preferably at both rod ends 48*a*,*b*, and the rack 42*a* is preferably spaced equidistantly inwardly from the rod ends 48*a*,*b* for allowing reciprocating movement thereof within the housing 30.

A flat yoke plate 52 is fixedly or integrally joined to the center of the rod 48 and is symmetrically laterally aligned with the rack 42*a*. As shown in FIG. 2, the plate 52 includes the slot 42*b* therein, with the plate 52 being disposed below and in parallel planes with the rack 42*a*. In the preferred embodiment illustrated in FIGS. 2 and 3, the input and output shafts 32, 34 are preferably parallel to each other as well as coaxially aligned about a common vertical centerline axis 54. As shown in FIG. 2, the yoke plate 52 is suitably positioned below the rack 42*a* for allowing room for the pinion 40 so that reciprocation of the yoke plate 52 clears the pinion and is not obstructed thereby during operation. This results in a compact arrangement of the crank 32*b*, the yoke 42, and the pinion 40 for converting unidirectional rotary motion of the input shaft 32 into bidirectional sinusoidal oscillatory motion of the output shaft 34. And, this also allows the output shaft 34 to corotate with the input shaft 32 during a spin cycle of the washer 10 wherein the basket 16 and agitator 18 spin together in rotary motion for allowing centrifugal force to drain the washing fluid from the clothes in the basket 16.

More specifically, conventional means 56 are schematically shown in FIG. 1 for mounting the transmission 28 by its housing 30 within the frame 22 for selectively restraining the transmission housing 30 from moving during the wash cycle so that rotation of the input shaft 32 oscillates the output shaft 34 and agitator 18 with sinusoidal motion. The mounting means 56 are also affective for allowing the transmission housing 30 to rotate when desired along with the input shaft 32 during the spin cycle so that the output shaft 34 corotates together with the input shaft 32 in only one direction. The mounting means 56 may therefore take any conventional form for allowing the transmission 28 to operate to produce oscillatory output motion in the wash cycle, while also allowing unidirectional rotation of the output shaft 34 in the spin cycle. For example, the mounting means 56 include tubular shafts around both the input and output shafts 32,34, and a brake assembly joined thereto which is conventionally operated so that the entire housing 30 rotates with the basket and agitator in the spin cycle. In the wash cycle, the housing remains stationary to allow the transmission to oscillate the agitator, while the basket remains stationary.

As indicated above, uniform circular rotation of the crank 32*b* and slider 38 thereon in the slot 42*b* produces a direct sinusoidal reciprocating motion of the yoke 42 within manufacturing tolerances. The angular speed of the agitator 18 is maximum when the crank 32*b* is disposed perpendicularly to the rod 48 in two lateral positions, one of which is illustrated in FIG. 3. The angular speed of the agitator 18 is zero, and the direction of rotation reverses, at the two opposite positions of the crank 32*b* aligned parallel with the longitudinal axis of the rod 48. The sinusoidal motion of the agitator 18 correspondingly minimizes the peak torque and power requirements of the motor 24, which therefore may be made suitably smaller than a conventional motor driving a conventional four-bar transmission.

Furthermore, the design of the agitator 18 itself may be simplified, and may use solid vanes as opposed to conventional flex vanes in view of the reduced peak torque operation. A conventional flex vane is undercut so that the radially outer portion thereof flexes in the circumferential direction in opposition to the loads provided by the washing fluid and clothes in the basket 16. Flexing or bending of the agitator vanes is a conventional manner for reducing peak torque requirements of the motor. The improved transmission 28 in accordance with the present invention reduces the peak torque requirements of the motor, and therefore the agitator vanes need not be of the undercut, flex design, but may be a solid design bonded to the base of the agitator 18 along the entire radial extent thereof as illustrated in FIG. 1.

Figure 4:
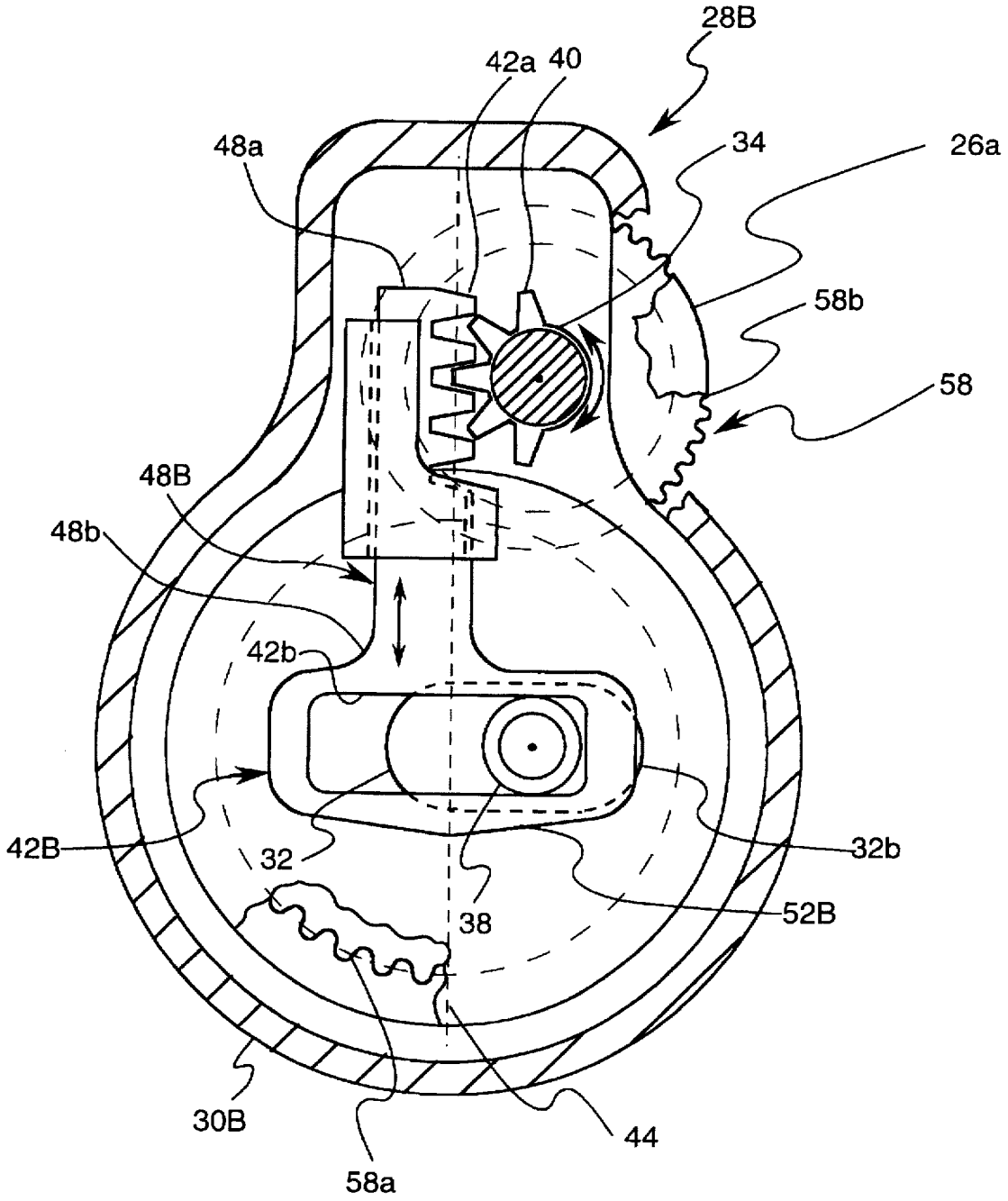
FIG. 4 is a horizontal, partly sectional view of a transmission in accordance with a second embodiment of the present invention.

FIG. 4 illustrates another embodiment of the transmission designated 28B which is effective for similarly converting unidirectional input rotation of the input shaft 32 into bidirectional, sinusoidal rotation of the output shaft 34. In this embodiment, the input and output shafts 32, 34 are again parallel to each other but are also laterally spaced apart and are not aligned coaxially with each other. The yoke is modified and is designated 42B, with the yoke plate 52B being disposed at one rod end **48*b* of the integral rod 48B, with the rack 42*a* being disposed at an opposite rod end 48*a*. The rack 42*a* and yoke plate 52B are coplanar in this embodiment. Furthermore, the input shaft 32 has a centerline axis which is disposed perpendicularly to and intersects the rack pitchline 44**.

In operation, the rotating crank **32*b* reciprocates the yoke 42B in linear translation symmetrically relative to the rack pitchline 44, thereby providing sinusoidally varying motion of the rack 42*a* upon uniform rotation of the input shaft 32. Linear reciprocation of the rack 42*a* in turn imparts sinusoidal rotary oscillation of the pinion 40, and in turn the output shaft 34 which is connected to the agitator 18 in this embodiment. All of the advantages of sinusoidal motion of the agitator 18** described above for the first embodiment are also available in this second embodiment.

Since the input and output shafts 32, 34 are not coaxially aligned, additional measures must be taken for allowing the housing 30B of this embodiment to rotate coaxially with rotation of the output shaft 34 in the spin cycle. This may be accomplished by providing additional means 58 for driving the input shaft 32, which is spaced laterally from the output shaft 34, for allowing the housing 30B to be rotated coaxially with the output shaft 34 during the spin cycle. The lower end of the input shaft 32 may be fixedly joined to a first gear **58*a* which in turn operatively engages a second gear 58*b* joined to an idler shaft coaxially with and below the output shaft 34. Joined to the other end of the idler shaft is a suitable drive pulley 26*a* of the belt drive 26 as illustrated in part in FIG. 4, and in elevation in FIG. 1**.

In this way, the drive pulley **26*a* may be coaxially aligned with the output shaft 34, with the input shaft 32 of the transmission 28B itself being offset therefrom. During the wash cycle, rotary input motion is effectively converted to sinusoidal output motion, and during the spin cycle, the entire transmission 28B may be allowed to rotate coaxially with the output shaft 34 for obtaining unitary corotation with the output shaft 34. In this embodiment of the transmission 28B, suitable balancing thereof should be provided, as well as suitable means for restraining rotation of the housing 30B** during the wash cycle.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A transmission for driving an agitator in a clothes washer comprising:

a housing;

an input shaft having a drive and for being rotated in a first direction, and having a crank at an opposite end thereof disposed inside said housing;

a slider rotatably joined to a distal end of said crank;

an output shaft having a pinion at one end disposed inside said housing, and having a driven end at an opposite end thereof disposed outside said housing for driving said agitator; and a yoke slidably mounted inside said housing between said crank and pinion, and including a rack operatively engaging said pinion along a pitchline, and a slot having a longitudinal slot axis disposed perpendicular to said rack pitchline and receiving therein said slider so that rotation of said input shaft reciprocates said rack as said slider reciprocates in said slot upon rotation of said crank, and said reciprocation of said rack oscillates said pinion in alternating opposite directions for oscillating said output shaft to drive said agitator, wherein said yoke further comprises: a rod having opposite ends and being slidably mounted to said housing, with said rack being disposed between said rod ends and a yoke plate fixedly joined to said rod and including said slot therein disposed in parallel planes with said rack, wherein said input and output shafts are parallel to each other, wherein said input and output shafts are laterally spaced apart, wherein said rack and yoke plate are disposed at respective ones of said rod ends, wherein said rack and yoke plate are coplanar, wherein said input shaft has a centerline axis disposed perpendicular to and intersecting said pitchline, and further comprising means coaxially aligned in part with said output shaft for driving said input shaft for allowing said housing to be rotated coaxially with said output shaft.

* * * * *